US007000919B2

(12) United States Patent
LiDonnici

(10) Patent No.: US 7,000,919 B2
(45) Date of Patent: Feb. 21, 2006

(54) SYSTEMS, METHODS AND KITS TO FACILITATE THE SOLUTION OF DIAGRAMLESS CROSSWORD PUZZLES

(76) Inventor: Kenneth M. LiDonnici, 433 E. 56th St., New York, NY (US) 10022

( * ) Notice: Subject to any disclaimer, the term of this patent is extended or adjusted under 35 U.S.C. 154(b) by 0 days.

(21) Appl. No.: 10/804,247

(22) Filed: Mar. 19, 2004

(65) Prior Publication Data

US 2004/0183253 A1 Sep. 23, 2004

Related U.S. Application Data

(60) Provisional application No. 60/456,267, filed on Mar. 20, 2003.

(51) Int. Cl.
*A63F 3/00* (2006.01)

(52) U.S. Cl. ..... 273/272; 273/153 R; 434/177

(58) Field of Classification Search ..... 273/284, 273/286, 287, 272, 153 R; 434/177
See application file for complete search history.

(56) References Cited

U.S. PATENT DOCUMENTS 2,050,498 A 8/1936 Mitchell
2,517,115 A * 8/1950 Kelly ..... 283/117
2,782,530 A 2/1957 Larroca
4,171,815 A * 10/1979 Sturtz ..... 273/272
4,209,173 A * 6/1980 Curtis et al. ..... 273/240
5,282,631 A 2/1994 Baker
5,288,068 A * 2/1994 Roth ..... 273/272
5,667,438 A 9/1997 Rehm
6,460,854 B1 * 10/2002 McCarey ..... 273/272
6,585,585 B1 7/2003 Fletcher

* cited by examiner

*Primary Examiner*—William M. Pierce
(74) *Attorney, Agent, or Firm*—Carter, DeLuca, Farrell & Schmidt, LLP

(57) ABSTRACT

The present disclosure relates to systems, methods, and kits for facilitating the solving and/or resolution of diagramless crossword puzzles. According to an embodiment of the present disclosure, a system for completing a diagramless crossword puzzle having a solution grid defining a rectilinear array of cells, is provided. The completion system includes a plurality of overlays each having a first and a second surface. Each overlay includes a grid formed on the first surface thereof. The grid of each overlay defines an array of cells. Accordingly, the overlays are selectively placable on a surface of the solution grid such that the array of cells of the overlay correspond with the rectilinear array of cells of the solution grid.

29 Claims, 9 Drawing Sheets

ACROSS

1. Transferable design
6. "____ Lot" (Stephen King novel)
12. Tease
16. Sky blue
17. Czech Republic capital
18. "Do ____ others..."
19. Start of a husband's greeting
21. He ad-libs fibs
22. Angeles or Alamos leader
23. Clinton's '92 and '96 opponent
24. Descendants
26. Social outcast
29. Convenient
30. Carrere of "Wayne's World"
33. Clair or Coty
34. Pythias' pal
36. Middle of the husband's greeting
39. ____-relief
42. Hale's role on "Perry Mason"
43. Swarm with activity
44. Carbonated cooler
45. Simoleons
46. Walks wearily
48. America's first saint
49. Indigo dye
50. Informal complaint
51. Direction for Christian Soldiers?
52. Butterfly collector's tool
53. End of the husband's greeting
56. Rice, to Ramon
57. Gore's title, in headlines
58. Affirmative vote
59. Bring to Broadway
62. Supporters of art?
64. Rental for the prom, perhaps
66. Like an autumn breeze
68. Amassed wagers
71. Ruler of Valhalla
72. Overworked housewife's reply
76. Type of golf club
77. Washington's Pennsylvania, e.g.
78. Ms. Rogers St. John
79. Humorist Bombeck
80. Proceeds toward evening
81. Lecherous deity

DOWN

1. "The Witches" author Roald
2. Basso Pinza
3. Bovines chew them
4. Exist collectively
5. Bound
6. "S" or "F", phonetically
7. Wearing mail
8. Christine of filmdom
9. Freudian concept
10. It's "the word," at times
11. Takes in
12. One of John Lennon's boys
13. Burger topper
14. Tolerate
15. Interested in equines
20. Say again
25. ____ En-lai
27. Found the sum
28. Garfield's predecessor
30. Explorer Abel
31. Chant
32. Skilled with one's hands
33. Sitcom star Perlman
35. Popular tattoo honoree
37. Artesian or wishing
38. "Knock ____!" ("That's enough!")
39. Luther Burbank's science
40. Silent star Renee
41. Justice O'Connor
44. Fastened with stitches
46. Black or orange tea
47. Talk show host Gibbons
48. Quick cut
50. Limbo dancing need
51. Ukraine or Texas city
53. TV's talkative trotter
54. Surplus printing
55. Experiences a second time
56. Meeting docket
59. Uncle Tom's creator
60. Henry VIII's dynasty
61. Self-evident statement
63. Part of an act
65. Televangelist Roberts
67. Elem. school orgs.
68. Meter man?
69. Having no siblings
70. Russian ruler of old
73. Zsa Zsa's sister
74. Sink below the horizon
75. Actress/director Lupino

*FIG. 3*

ACROSS

1. Transferable design
6. "____ Lot" (Stephen King novel)
12. Tease
16. Sky blue
17. Czech Republic capital
18. "Do ____ others..."
19. Start of a husband's greeting
21. He ad-libs fibs
22. Angeles or Alamos leader
23. Clinton's '92 and '96 opponent
24. Descendants
26. Social outcast
29. Convenient
30. Carrere of "Wayne's World"
33. Clair or Coty
34. Pythias' pal
36. Middle of the husband's greeting
39. ____-relief
42. Hale's role on "Perry Mason"
43. Swarm with activity
44. Carbonated cooler
45. Simoleons
46. Walks wearily
48. America's first saint
49. Indigo dye
50. Informal complaint
51. Direction for Christian Soldiers?
52. Butterfly collector's tool
53. End of the husband's greeting
56. Rice, to Ramon
57. Gore's title, in headlines
58. Affirmative vote
59. Bring to Broadway
62. Supporters of art?
64. Rental for the prom, perhaps
66. Like an autumn breeze
68. Amassed wagers
71. Ruler of Valhalla
72. Overworked housewife's reply
76. Type of golf club
77. Washington's Pennsylvania, e.g.
78. Ms. Rogers St. John
79. Humorist Bombeck
80. Proceeds toward evening
81. Lecherous deity

DOWN

1. "The Witches" author Roald
2. Basso Pinza
3. Bovines chew them
4. Exist collectively
5. Bound
6. "S" or "F", phonetically
7. Wearing mail
8. Christine of filmdom
9. Freudian concept
10. It's "the word," at times
11. Takes in
12. One of John Lennon's boys
13. Burger topper
14. Tolerate
15. Interested in equines
20. Say again
25. ____ En-lai
27. Found the sum
28. Garfield's predecessor
30. Explorer Abel
31. Chant
32. Skilled with one's hands
33. Sitcom star Perlman
35. Popular tattoo honoree
37. Artesian or wishing
38. "Knock ____!" ("That's enough!")
39. Luther Burbank's science
40. Silent star Renee
41. Justice O'Connor
44. Fastened with stitches
46. Black or orange tea
47. Talk show host Gibbons
48. Quick cut
50. Limbo dancing need
51. Ukraine or Texas city
53. TV's talkative trotter
54. Surplus printing
55. Experiences a second time
56. Meeting docket
59. Uncle Tom's creator
60. Henry VIII's dynasty
61. Self-evident statement
63. Part of an act
65. Televangelist Roberts
67. Elem. school orgs.
68. Meter man?
69. Having no siblings
70. Russian ruler of old
73. Zsa Zsa's sister
74. Sink below the horizon
75. Actress/director Lupino

*FIG. 5*

SYSTEMS, METHODS AND KITS TO FACILITATE THE SOLUTION OF DIAGRAMLESS CROSSWORD PUZZLES

CROSS-REFERENCE TO RELATED APPLICATIONS

The present application claims the benefit of and priority to U.S. Provisional Application No. 60/456,267, filed on Mar. 20, 2003, the entire content of which is incorporated herein by reference.

BACKGROUND

1. Technical Field

The present disclosure relates generally to diagramless crossword puzzles, and more particularly, to systems, methods, and kits for facilitating the solving and/or resolution of diagramless crossword puzzles.

2. Background of Related Art

Generally, diagramless crosswords are those which the "Across" and "Down" clues are given. However, unlike regular crosswords, in diagramless crossword puzzles, the actual diagram of the puzzle (i.e., the numbered grid with certain of the cells blacked) is not provided. Only the number of cells comprising the height and width of the grid are disclosed. Occasionally, the location of the starting cell is disclosed.

Accordingly, unlike regular crosswords, diagramless crosswords require the participant to not only answer the clues, but to turn the entirely featureless grid into a regular crossword grid by figuring out where the black cells are located and marking them as such, and to figuring out where all the clue numbers go in the cells of the crossword grid. Typically, for all but the first "Across" clue, one needs to guess how long the answer is.

In solving a diagramless crossword puzzle, the following tips have been offered. First, the length of the first Across answer is determined. The length of the first Across answer is determined by subtracting one (1) from the number of the second Across clue. For example, if the second Across clue is numbered "6", then the answer to the 1-Across clue is five (5) letters long.

Then try to write in the answer to 1-Across, which would provide the starting letters for the 1-Down, 2-Down, 3-Down, 4-Down and 5-Down answers. Remember, the cell of the grid at the beginning and at the end of each answer should be blackened.

Often, American crosswords have mirror symmetry (i.e., the pattern of black and white squares in the puzzle look the same if the grid is turned upside down). There are other variations of the symmetry of the diagram, for example, left-right or up-down symmetry. Indeed, in some rare instances, the diagram may be slightly asymmetrical.

It is this very manipulation of usable information that makes the invention of the present disclosure so useful in achieving the intellectual satisfaction in the successful solution of these puzzles.

In view of the foregoing, a continuing need exists for devices and methods for facilitating the resolution of diagramless crossword puzzles.

SUMMARY

The present disclosure relates to systems, methods and kits for solving diagramless crossword puzzles.

According to an embodiment of the present disclosure, a system for completing a diagramless crossword puzzle having a solution grid defining a rectilinear array of cells, is provided. Preferably, the number of its cells is greater than the maximum number of cells that the final diagram may ultimately occupy. The completion system includes a plurality of overlays each having a first and a second surface, of the same horizontal and vertical pitch as those of the solution grid. Each overlay includes a grid formed on the first surface thereof. The grid of each overlay defines an array of cells. Accordingly, the overlays are selectively placable on a surface of the solution grid such that the array of cells of the overlay correspond with the rectilinear array of cells of the solution grid. Typically, these overlays may contain approximately six to eight squares extending in both a vertical and a horizontal direction.

Each overlay may be fabricated from a flexible sheet material. The flexible sheet material may be a paper-based material and/or a plastic film-based material. Preferably, each overlay includes a coating of a selectively repositionable adhesive medium provided on at least a portion of the second surface thereof. The adhesive medium is at least one of acrylate co-polymers, silicone materials, urethanes, and fluoro polymers.

In one embodiment, a plurality of overlays may be operatively joined to one another in a sheet of overlays. As such, a plurality of sheets of overlays may be operatively joined to one another in a stack. Each overlay of each sheet is preferably separated from one another by a line of perforations.

The system may further include at least one solution grid having a rectilinear array of cells. The system may further include a set of instructions for using the completion system. The system may further include at least one set of clues for completing a diagramless crossword puzzle.

According to another aspect of the disclosure, a method of solving a diagramless crossword puzzle, is provided. The method includes the step of providing a diagramless crossword puzzle completion system. The completion system includes at least a plurality of overlays each having a first and a second surface. Each overlay includes a grid formed on the first surface thereof. The grid of each overlay defines an array of cells, wherein the overlays are selectively placable on a surface of the solution grid such that the array of cells of the overlay correspond with the rectilinear array of cells of the solution grid.

The method further includes the steps of identifying corner cells of the diagramless crossword puzzle; placing a first overlay on a solution grid; beginning resolution of a portion of the puzzle on the first overlay; marking each cell immediately adjacent to a cell corresponding to the final letter of each Across answer and each Down answer; beginning resolution of other portions of the puzzle on other overlays; and arranging the overlays to resolve the diagram of the puzzle.

The method further includes the steps of determining a length of a first Across answer; numbering the cells to the right from an upper left-most cell from the number one up to the number of the length of the first Across answer; and marking a cell to the right of the cell corresponding to the final cell for the first Across answer.

The method further includes the steps of placing another overlay on the first overlay; transposing the marked cells of the first overlay to the another overlay; rotating the another overlay by 180°; and placing the another overlay on a lower right-most portion of the solution grid.

The method may further include the step of determining the size of a solution grid for the puzzle. The step of identifying the corner cells includes marking Across clues and Down clues, sharing a common clue number, with identifying indicia. The step of beginning resolution of the puzzle includes determining answers for the Across clues and the Down clues.

The step of determining the length of the first Across answer includes subtracting one from the number of a second Across clue. The method may further include the step of determining a length of a second Across answer. Determination of the length of the second Across answer includes subtracting the length of the first Across answer from the number of a third Across clue.

The method further includes the step of placing overlays on at least an upper-half portion of the solution grid; resolving the puzzle on the overlays placed on at least the upper-half portion of the solution grid; placing additional overlays on the overlays covering at least the upper-half portion of the solution grid; and transposing any marked cells from the overlays covering at least the upper-half portion of the solution grid to the additional overlays.

The method further includes the steps of rotating the additional overlays; and placing the additional overlays on a lower-half portion of the solution grid.

The step of providing the completion system further includes providing at least one solution grid having a rectilinear array of cells and/or providing a set of instructions for using the completion system.

Preferably, the overlays lay one atop at least a portion of another. Desirably, the placing of the first overlay on the solution grid includes placing an upper left-most cell of the overlay on a cell of the solution grid located in an upper row of the solution grid and on a cell of the solution grid located to the right of a left-most column of the solution grid.

The method further includes the steps involved in the use of the overlays. One method would be to use a separate overlay for each highlighted Corner square, which are those squares having a common numbered clue in both the Across and Down directions. The method further includes the step of filling in as many of the answers as can be reasonably guessed at.

The method further includes the step of positioning the overlays on the solution grid, wherein at first the only definite clue is that the overlay containing square number one should be positioned at the top of the solution grid, somewhere to the left thereof, preferably at the center thereof.

The method further includes the step of exercising the puzzle solver's acumen in observing the flow of letters in the already-solved words or word segments, and superimposing the overlays as required to form the intelligible words. It is at this point that surmising the type of symmetry the puzzle may possess.

A kit for completing a diagramless crossword puzzle is also provided. The kit includes at least one solution grid defining a rectilinear array of cells; and a plurality of overlays. Each overlay has a first and a second surface with a grid formed on the first surface thereof. The grid of each overlay may define an array of cells. The overlays may be placed on a surface of the solution grid such that the array of cells of the overlay correspond with the rectilinear array of cells of the solution grid. Desirably, each overlay may include a coating of a selectively repositionable adhesive medium provided on at least a portion of the second surface thereof.

The kit may further include instructions for using the plurality of overlays to resolve a diagramless crossword puzzle. The kit further includes a booklet of clues.

These and other features of the disclosure will become more clearly illustrated below by the description of the drawings and the detailed description of the preferred embodiments.

BRIEF DESCRIPTION OF THE DRAWINGS

The accompanying drawings, which are incorporated in and constitute a part of the specification, illustrate embodiments of the invention, and together with a general description of the invention given above, and the detailed description of the embodiments given below, serve to explain the principles of the invention.

FIG. 3 is an exemplary set of clues for use in resolving the diagramless crossword puzzle;

FIG. 5 depicts the first step of the method of FIG. 4;

DETAILED DESCRIPTION

With reference to FIGS. 1–13, there is shown a system for completing a diagramless crossword puzzle, generally designated as 100, and a method for using system 100 to allow a user to solve and/or complete a diagramless crossword.

Completion system 100 may include a solution grid 102 (see FIG. 1) on which the diagramless crossword puzzle is to be completed. Solution grid 102 includes an array of cells defined by a row or plurality of cells $A_N$ extending across solution grid 102 and a column or plurality of cells $D_N$ extending down solution grid 102. While solution grid 102 is shown as having a different number of across cells $A_N$ and down cells $D_N$, forming a rectangular solution grid, it is contemplated that solution grid 102 may include the same number of across cells $A_N$ and down cells $D_N$, forming a square solution grid. Each cell of solution grid 102 preferably has a uniform height and width.

Figure 1:
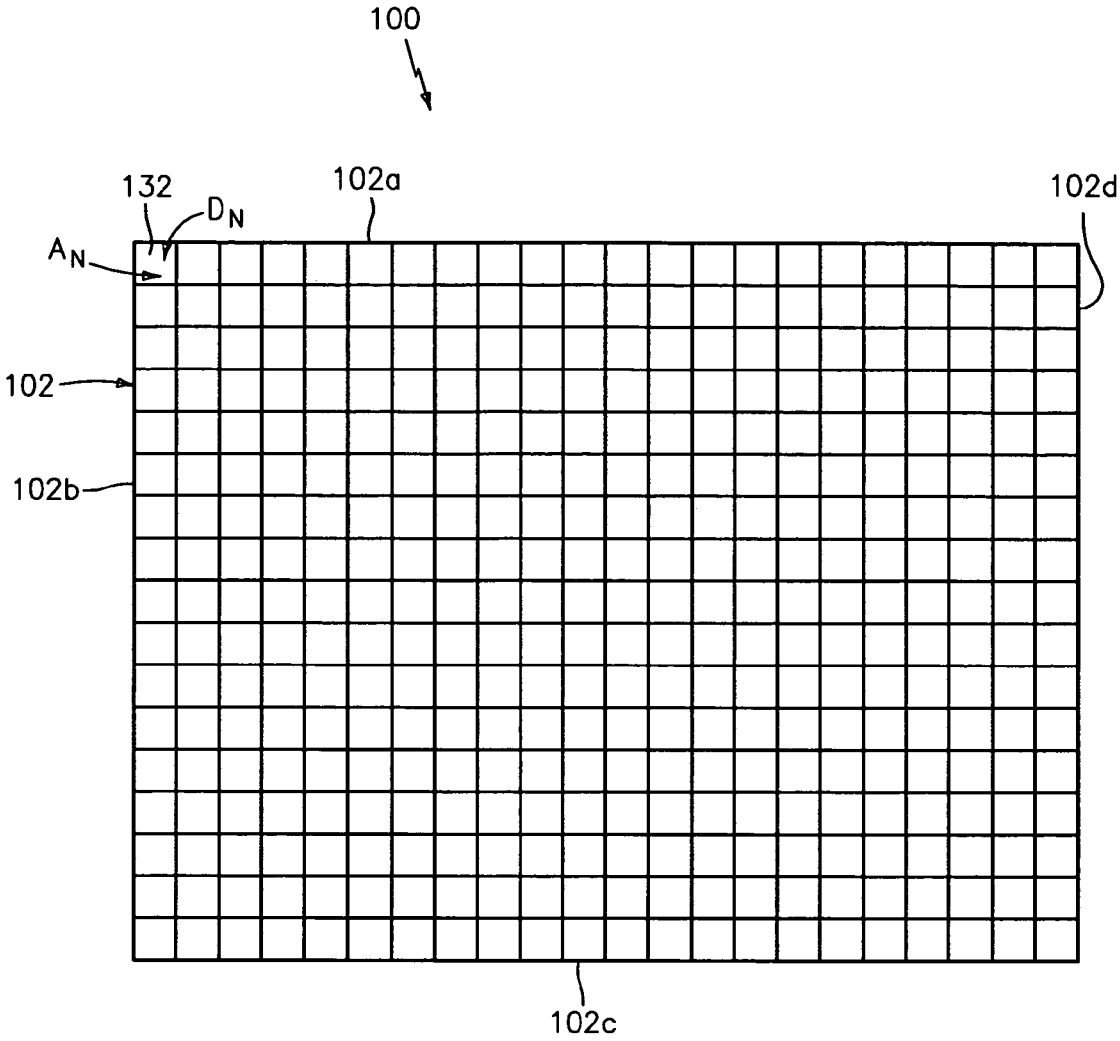
FIG. 1 is a plan view of an exemplary solution grid for a diagramless crossword puzzle.
Figure 2:
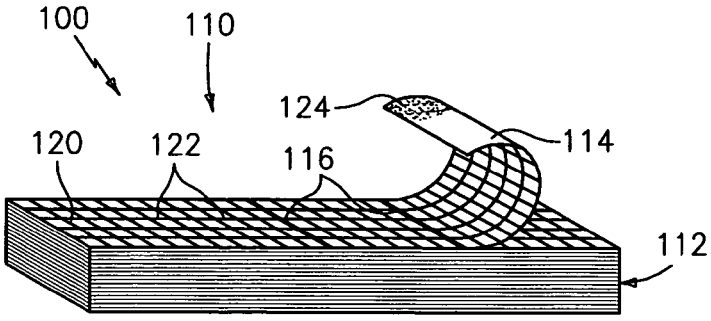
FIG. 2 is a perspective view of a stack of overlays for placement on the solution grid of FIG. 1.

As seen in FIG. 2, completion system 100 includes a plurality of stickers or overlays 110. Preferably, overlays 110 are provided in a stack 112 of sheets 114. It is envisioned that each sheet 114 is perforated or provided with a tear line 116 formed between adjacent overlays 110. Each overlay 110 includes a grid 120 formed on a first surface thereof defining an array of cells 122. Preferably, cells 122 of overlay 110 are sized and/or dimensioned (i.e., have a height and a width) to substantially correspond to the size and/or dimension (i.e., height and width) of cells $A_N$, $D_N$ of solution grid 102.

Desirably, each overlay 110 includes a coating 124 of a selectively reusable and/or repositionable adhesive medium (e.g., low adhesion backsize) provided on at least a portion of a second surface thereof (i.e., a surface opposite the first surface) such that each overlay 110 is selectively repositionable. Each overlay may be fabricated from a flexible sheet material including and not limited to paper-based (e.g., paper, cardboard, etc.) and plastic film-based materials (e.g., polyethylene, polypropylene and polyester). Use of a plastic film-based material has the advantage that overlays 110 may be reusable (i.e., the marking formed thereon during use may be erased and/or wiped off). Moreover, it is envisioned that each overlay 110 is fabricated from a material which may be written on by pen, pencil, grease pencil, marker and/or crayon.

The adhesive medium or low adhesion backsize (LAB) material may be any suitable material including, but not limited to, acrylate co-polymers, silicone materials, urethanes, and fluoro-polymers. For example, the LAB material may be a water-based solution of the material described in EP-A-0618509, the entire contents of which are incorporated herein by reference, the solution comprising typically from about 5% to about 10% solid material. Other LAB materials that may be employed include those disclosed in U.S. Pat. Nos. 5,202,190 and 5,032,460, the entire contents of each of which being incorporated herein by reference. Preferably, the adhesive medium is a repositionable microsphere pressure-sensitive adhesive, for example as described in U.S. Pat. Nos. 5,045,569; 4,495,318; 4,166,152; 3,857,731; 3,691,140; U.S. Pat. No. Re 24906; U.S. Pat. No. 5,571,617 and EP-A-0439,941, the entire contents of each of which being incorporated herein by reference.

Figure 2A:
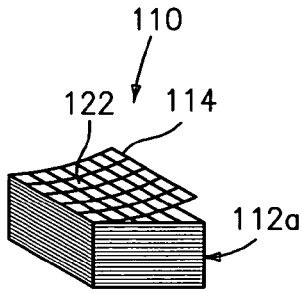
FIG. 2A is a perspective view of a stack of overlays, according to another embodiment of the present disclosure, for placement on the solution grid of FIG. 1.

As seen in FIG. 2A, an alternate embodiment for the stack of overlays is shown as stack 112*a*. Stack 112*a* of overlays 110 includes a plurality of individual sheets 114 including 6 to 8 cells 122 extending in both the Across and Down directions.

Completion system 100 may be used to complete a diagramless crossword puzzle having clues "C" as shown in FIG. 3. Clues "C" of FIG. 3 are merely exemplary and are not intended to in any way limit the scope of the present disclosure. Clues "C" of FIG. 3 are intended to be used in connection with a diagramless crossword puzzle having a seventeen cell wide and a seventeen cell high solution grid.

Figure 4:
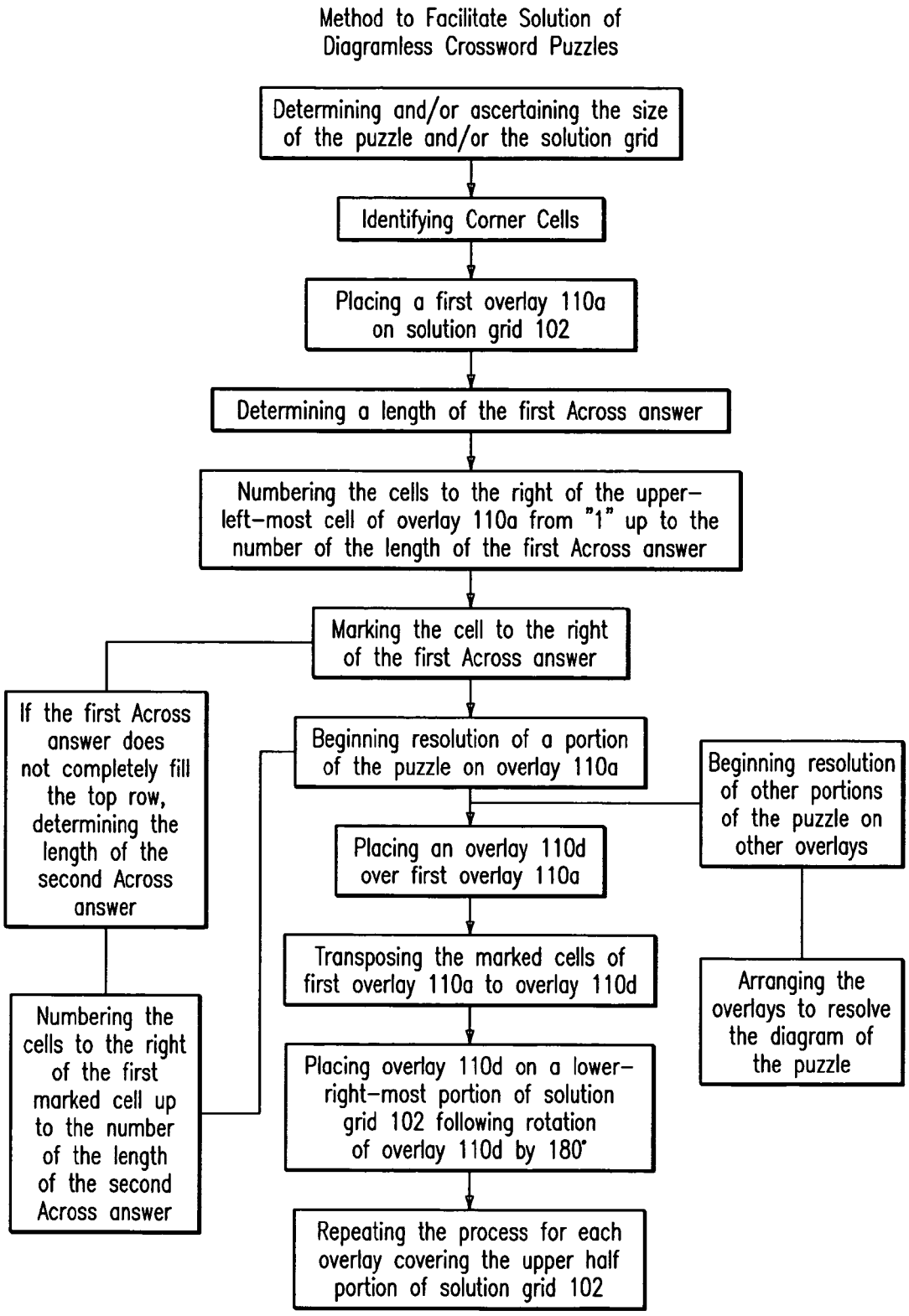
FIG. 4 is a flow chart illustrating a method, in accordance with the present disclosure, for resolving the diagramless crossword puzzle with the exemplary clues of FIG. 3.

With particular reference to FIGS. 4–13, a method of using completion system 100 to solve a diagramless puzzle, is shown and described. As seen in FIG. 4, a flow chart illustrating an exemplary method of solving a diagramless crossword puzzle, having, for example, the clues of FIG. 3, is shown.

The method includes the steps of providing a completion system 100 including a plurality of or stack 112 of stickers or overlays 110. The method may further include the step of providing a solution grid 102. While the method may include the step of providing a solution grid 102, it is envisioned that the method according to the present disclosure may be performed in connection with a solution grid provided together with clues "C" of the diagramless crossword puzzle.

Initially, if a solution grid is not provided with clues "C" of the diagramless crossword puzzle, the method may further include the step of determining and/or ascertaining the size of solution grid 102 required and delineating the overall size of solution grid 102.

Alternatively, if a solution grid 102 is provided, the method initially requires identification of corner cells 130 of solution grid 102. Corner cells 130 are cells of solution grid 102 which share a common clue number "$C_C$" (i.e., the number of the across clue is the same as the number of the down clue). Identification of corner cells 130 requires marking of the across "$C_A$" and the down clues "$C_D$", sharing the common clue number "$C_C$", with an identifying feature and/or characteristic. For example, as seen in FIG. 5, the across and down clues "$C_A$, $C_D$" having common clue numbers "$C_C$" (i.e., clues 1, 6, 12, 30, 33, 39, 44, 46, 48, 50, 51, 53, 56, 59 and 68) have been bolded. However, it is envisioned and within the scope of the present disclosure, to mark common clues "$C_C$" by any discernable method, such as, for example, by at least one hi-liting, underlining, circling, asterisking, etc.

With corner cells 130 identified, it is then known that the cells immediately above and the cells immediately to the left of corner cells 130 are blank and may be filled in or blackened. Additionally, a numbered cell that is Across only must have at least one blank square which is immediately to the left thereof. The numbered cell that is Across only typically identifies at least one open cell above it, which at least one open cell above is part of a Down answer or word whose beginning is somewhere above this open cell. Likewise, a numbered cell that is Down only, must have at least one blank square which is immediately above it. The numbered cell that is Down only typically identifies at least one open cell to its left, which at least one open cell to the left is part of an Across answer or word whose beginning is somewhere to the left of this open cell.

By highlighting all of the clue numbers, i.e., common clues "$C_C$" or "corner" squares, that appear in both the Across clues "$C_A$" and the Down clues "$C_D$", and realizing that the squares immediately above and immediately to the left of these "corner" squares must necessarily be blank, one gains some insight as to the puzzle's final configuration.

As described above, further insight is gained from the realization that a numbered square that is Across only must have a blank square immediately to its left, but NOT above it, and that this square contains a letter that is part of a Down word whose beginning is somewhere above. Similarly, a numbered square that is Down only must have a blank square above it, and must contain a letter that is part of an Across word whose beginning is somewhere to its left.

The method next requires determination of the length of the first Across answer. The length of the first Across answer is determined by subtracting one (1) from the number of the second Across clue. For example, as seen from FIG. 5, if the second Across clue is numbered "6", then the length of the first Across answer is five (5) cells long (e.g., six minus one).

Figure 6:
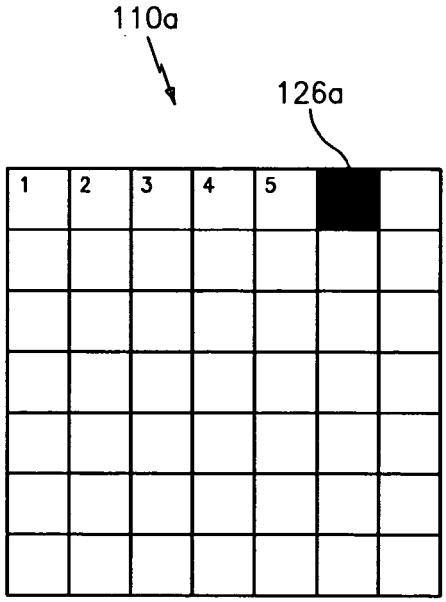
FIG. 6 is a plan view of an overlay of the stack of overlays of FIG. 2, depicting another step of the method of FIG. 4.

As seen in FIG. 6, the cells extending across a first overlay 110*a* are then numbered consecutively from one (1) to five (5), i.e., the length of the first Across answer. Next, cell 126*a* of first overlay 110*a*, immediately to the right of the cell which is to contain the last character of the first Across answer, is marked (e.g., filled in or blackened). For instance, from the example given above, as seen in FIG. 6, cell 126*a* of first overlay 110*a*, immediately to the right of the cell marked with the numeral "5" is blackened.

Figure 7:
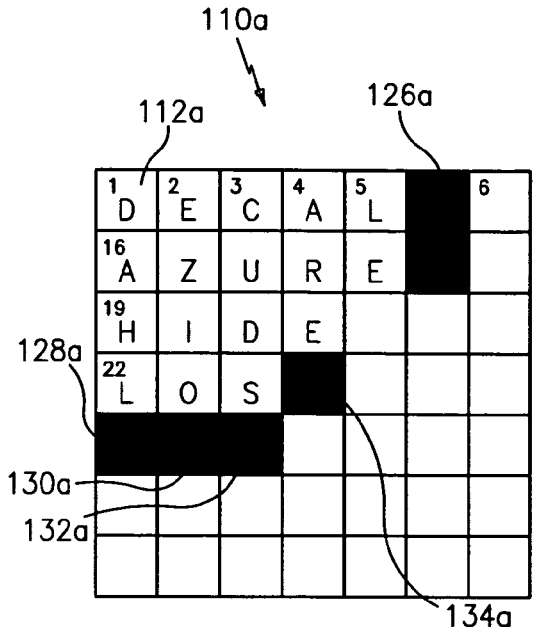
FIG. 7 is a plan view of the overlay of FIG. 6, depicting another step of the method of FIG. 4.

Turning now to FIG. 7, resolution of the first Across answer as well as Down answers one through five is attempted. As seen in FIG. 7, these answers are resolved and may be filled in. As Down answers one through five are resolved, the cell immediately below the last letter of the Down answer is blackened. These blackened cells are identified as 128*a*, 130*a*, 132*a* and 134*a*.

Figure 8:
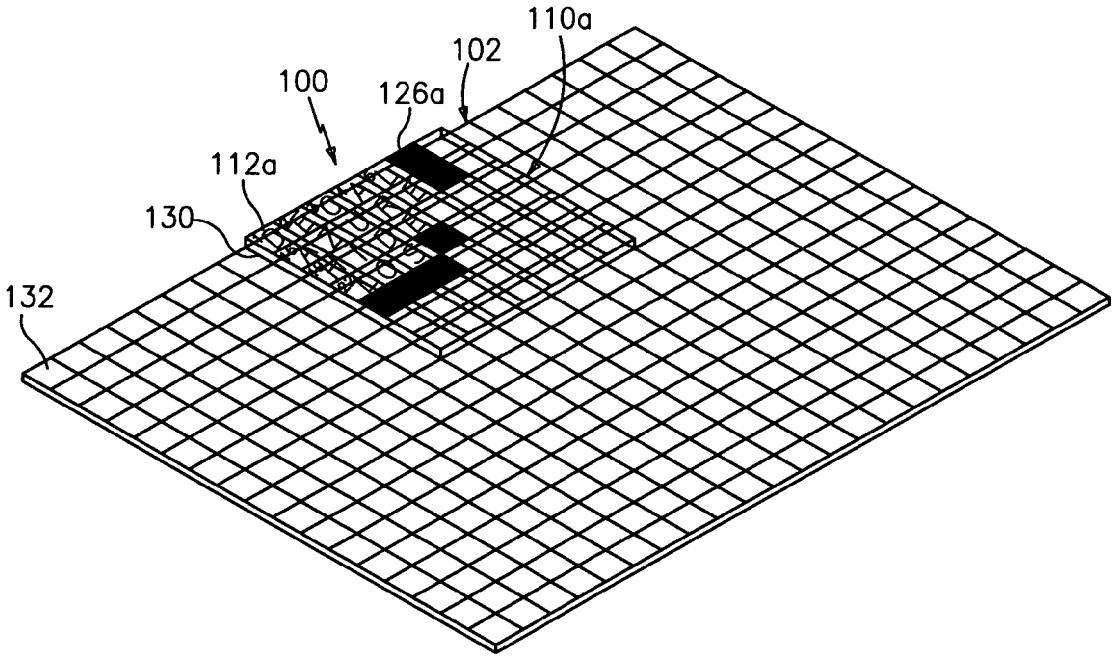
FIG. 8 is a perspective view of the solution grid of FIG. 7, illustrating the placement of the overlay of FIGS. 6 and 7 on the solution grid of FIG. 1, according to a method of the present disclosure.
Figure 9:
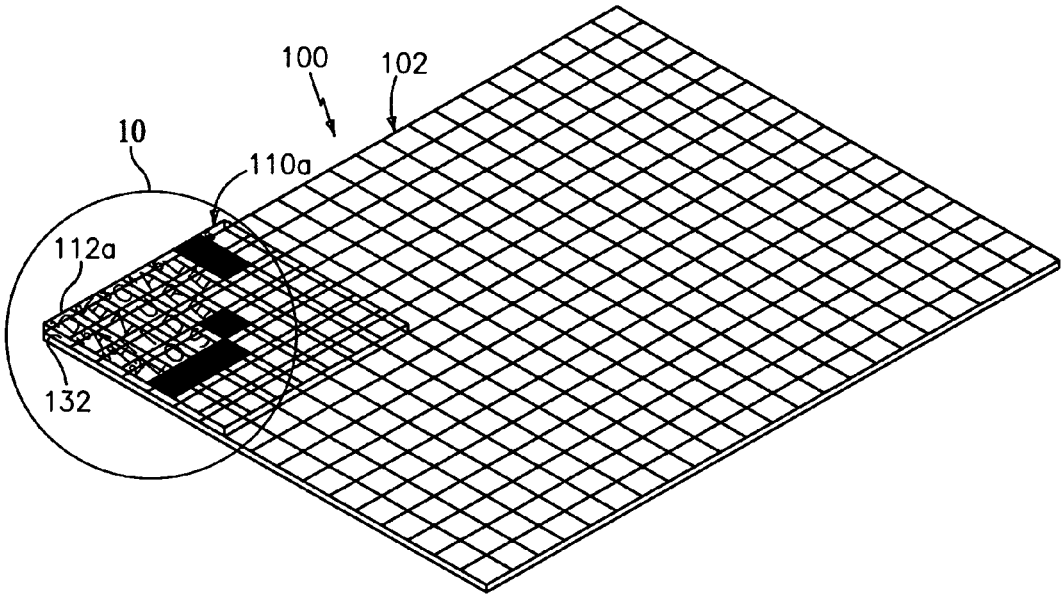
FIG. 9 is a perspective view of the solution grid of FIG. 8, illustrating an alternative placement of the overlay of FIGS. 6 and 7 on the solution grid of FIG. 1.
Figure 10:
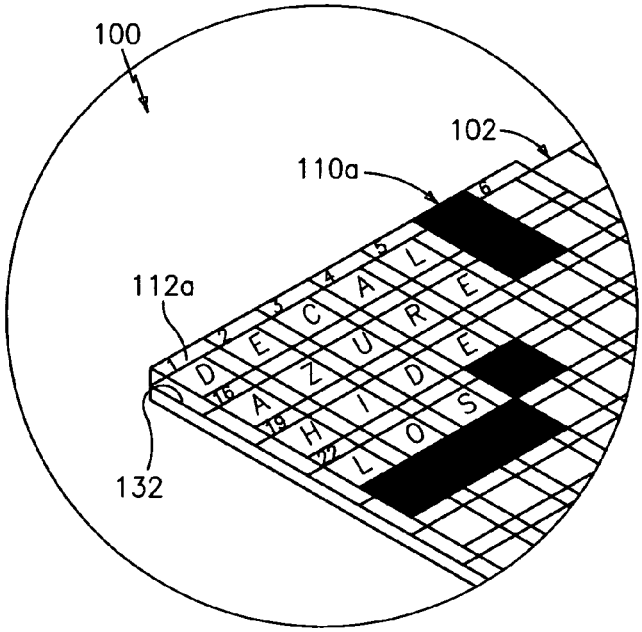
FIG. 10 is an enlarged perspective view of the area indicated as "10" of FIG. 9.

Next, as seen in FIG. 8, first overlay 110*a* is placed on solution grid 102. Preferably, first overlay 110*a* is placed on solution grid 102 such that upper left-most cell 130*a* (i.e., the cell of overlay 110*a* numbered "1") is placed on solution grid 102 to overlie a cell 130 of solution grid 102 which is in the upper-most row of cells of solution grid 102 and at a location to the right of the left-most column of cells of solution grid 102, preferably at or near the center-most cell in the upper-most row of cells of solution grid 102.

Adhesive coating 124 inhibits accidental or inadvertent movement or removal of first overlay 110*a* from solution grid 102.

During resolution of the diagramless crossword puzzle, as seen in FIGS. 9–13, overlay 110*a* may be placed on solution grid 102 such that cell 112*a* of overlay 110*a* is positioned over the upper left-most cell 132 of solution grid 102. For instance, if, during the resolution of the diagramless crossword puzzle, it is determined that overlay 110*a* is placed too far to the right on solution grid 102, overlay 110*a* may be moved to the left on solution grid 102, along the upper-most row of cells. In an alternative method, overlay 110*a* may be placed on solution grid 102 such that cell 112*a* of overlay is positioned over the upper left-most cell 132 of solution grid 102 from the beginning.

Figure 11:
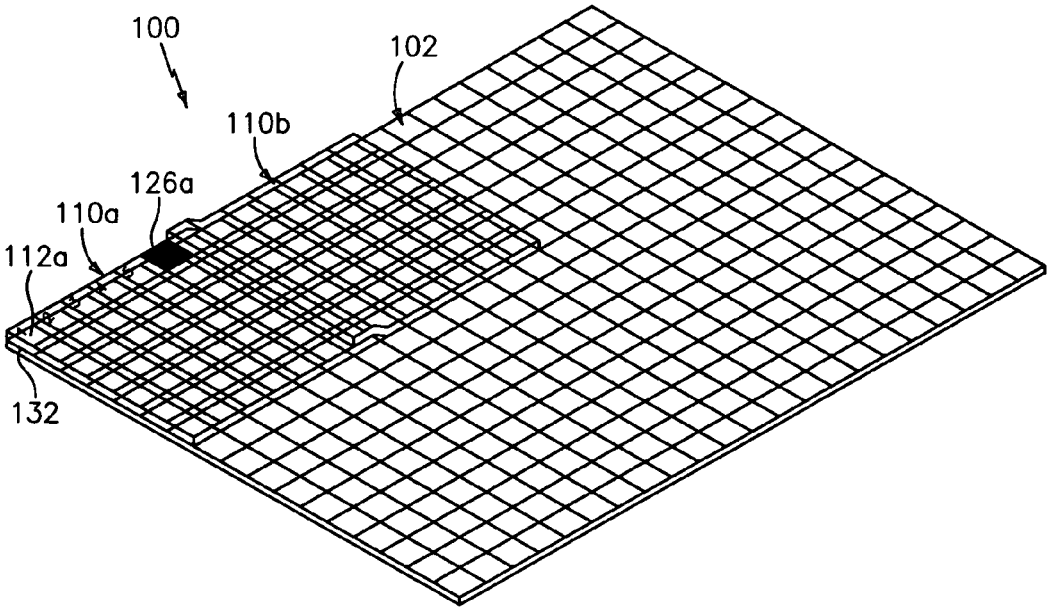
FIG. 11 is a perspective view of the solution grid of FIG. 10, illustrating another step in the method of the present disclosure.
Figure 12:
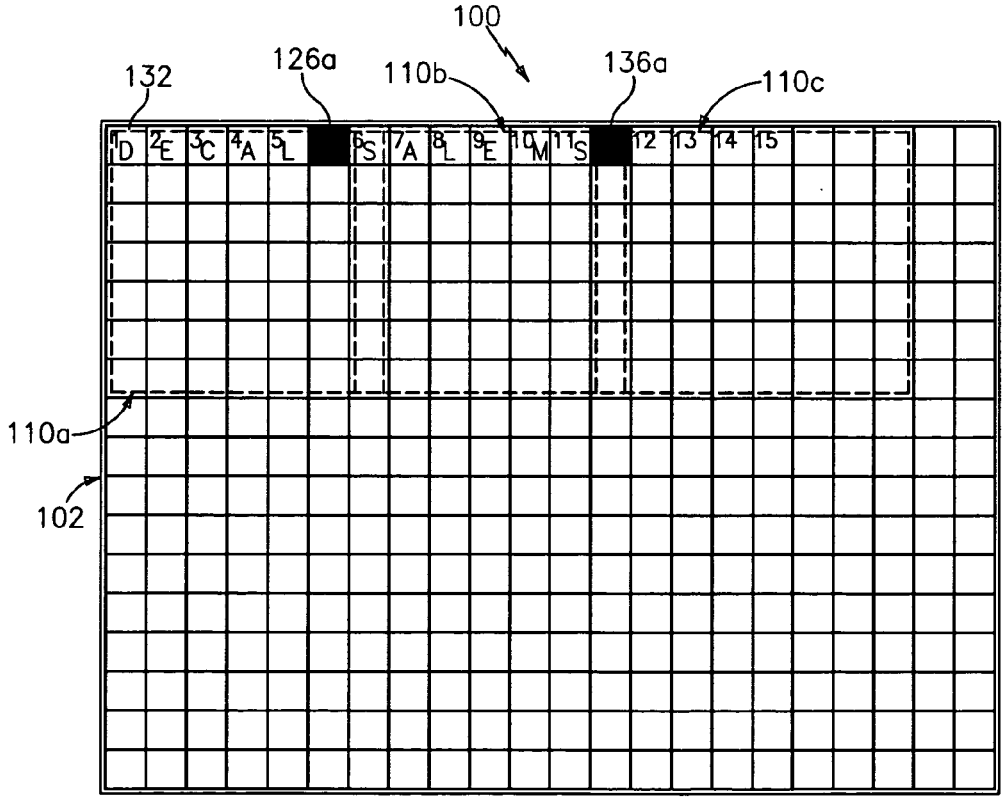
FIG. 12 is a plan view of the solution grid of FIG. 1 illustrating yet another step in the method of the present disclosure.
Figure 13:
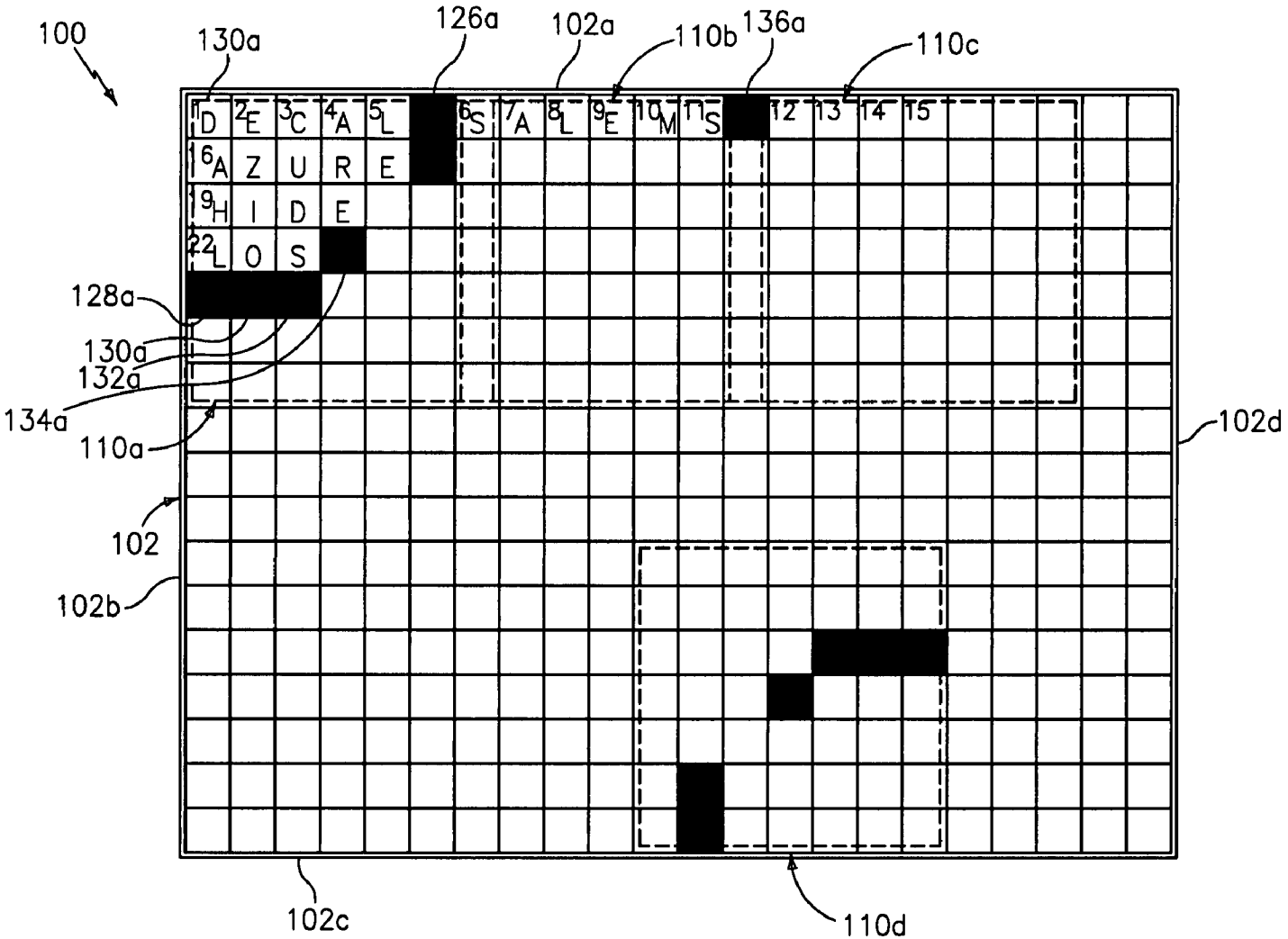
FIG. 13 is a plan view of the solution grid of FIG. 12 illustrating still another step in the method of the present disclosure.

Next, additional overlays are placed on solution grid 102 and/or on overlay 110*a* in order to complete other portions of the diagramless crossword puzzle. For example, as seen in FIGS. 11–13, additional overlays 110*b*, 110*c*, etc. may be placed on solution grid 102 to thereby entirely cover an upper half portion of solution grid 102. Preferably, overlays 110*a*, 110*b*, 110*c* are placed on solution grid 102 such that overlays 110*a*, 110*b*, 110*c* overlap one another by at least on cell width. However, it is envisioned that overlays 110*a*, 110*b*, 110*c*, may be placed on solution grid 102 such that the edges of overlays 110*a*, 110*b*, 110*c* abut against, are in contact with, are adjacent and/or overlap one another.

Should the player become stumped, the player may begin resolution of another portion of the puzzle by commencing with resolution of other common clues "$C_C$" on other overlays. The player may then attempt to place these overlays on solution grid 102 at locations where the player believes these solution fit.

According, to an alternate method, if the first Across answer does not completely fill the top row of solution grid 102, the length of the second Across answer may be determined by subtracting the number of the second Across clue from the number of the third Across clue. Therefore, as seen from FIG. 5, if the second Across clue is numbered "6" and the third Across clue is numbered "12", then the length of the second Across answer is six (6) cells long. At such time, as seen in FIG. 12, the cells to the right of cell 126*a* of overlay 110*a* may be marked consecutively from six (6) to eleven (11). Next, the cell to the right of the cell numbered "11", i.e., cell 136*a* (corresponding to the upper right-most cell of overlay 110*b* and/or to the upper left-most cell of overlay 110*c*) as seen in FIG. 12, may be blackened.

If the first and second Across answers do not completely fill the top row of solution grid 102, then the length of the third Across answer may be determined by subtracting the number of the third Across clue from the number of the fourth Across clue. Therefore, as seen from FIG. 5, if the third Across clue is numbered "12" and the fourth Across clue is numbered "16", then the length of the third Across answer is four (4) cells long. At such time, as seen in FIG. 12, the cells to the right of cell 136*a* may be marked consecutively from twelve (12) to fifteen (15). In the present example, the third Across answer completely fills the first row of solution grid 102.

Should the player believe that the puzzle contains some degree of symmetry, following resolution of all or at least a portion of the diagramless crossword puzzle corresponding to overlay 110*a*, another overlay 110*d* may be placed over overlay 110*a* in order to transpose the filled in cells thereof (e.g., cells 126*a*, 128*a*, 130*a*, 132*a* and 134*a*) to overlay 110*d*. If the, diagramless crossword puzzles is symmetrical (i.e., the blackened cells are in the same relative location on solution grid 102 when solution grid 102 is right-side up and upside down).

With blackened cells 126*a*–134*a* of overlay 110*a* transposed onto overlay 110*d*, as seen in FIG. 13, overlay 110*d* is rotated 180° and placed on the lower right-most portion of solution grid 102. In particular, when overlay 110*d* is in position over overlay 110*a*, an upper-most edge of overlay 110*d* is aligned with an upper-most edge 102*a* of solution grid 102 and a left-most edge of overlay 110*d* is aligned with a left-most edge 102*b* of solution grid 102. When overlay 110*d* is placed on the lower right-most portion of solution grid 102, the upper-most edge of overlay 110*d* is aligned with a lower-most edge 102*c* of solution grid 102 and the left-most edge of overlay 110*d* is aligned with a right-most edge 102*d* of solution grid 102.

This process is repeated for each of overlays 110*b* and 110*c* such that a lower portion of solution grid 102 is covered with new overlays (not shown) corresponding to overlays 110*b*, 110*c* (i.e., the filled-in cells of overlays 110*b*, 110*c* have been transposed to the new overlays and the new overlays rotated 180° and placed on the lower portion of solution grid 102). Preferably, this process is repeated until the entirety of solution grid 102 is covered with overlays 110.

Once solution grid 102 has been covered with overlays 110 and the cells of the overlays filled-in to reveal and/or otherwise define the pattern of the diagramless crossword puzzle, the diagramless crossword puzzle may be completed like a normal crossword puzzle.

Figure 14:
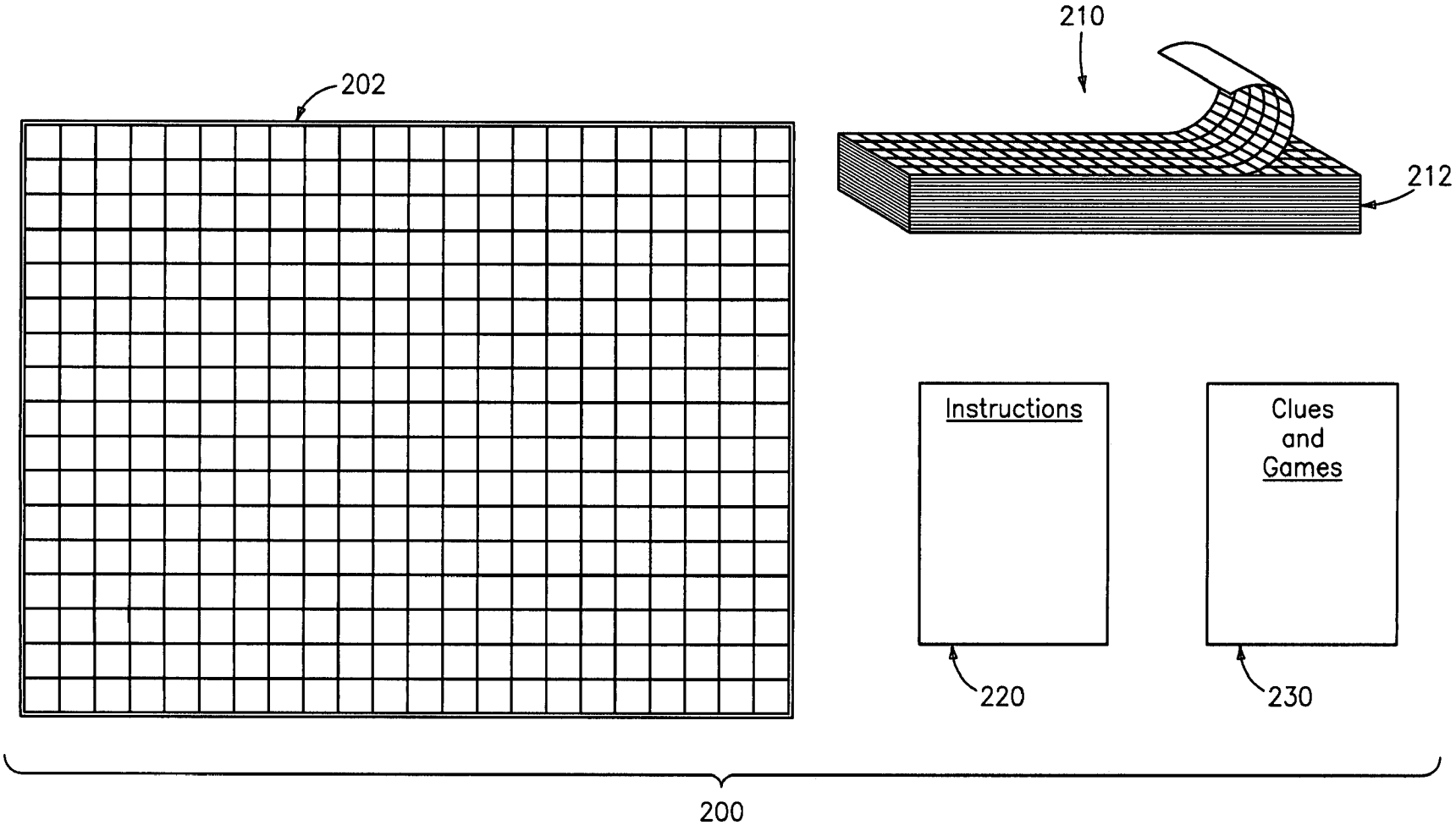
FIG. 14 is a schematic illustration of a completion system according to another embodiment of the present disclosure.

As seen in FIG. 14, a system for completing a diagramless crossword puzzle, which is in the form of a kit, is generally designated as 200. Kit 200 includes at least one solution grid 202 (each solution grid 202 being substantially similar to solution grid 102), a plurality of overlays 210 preferably provided in a stack 212 (stack 212 of overlays 210 being substantially similar to stack 112 of overlays 110), and a set of instructions 220.

Instructions 220 include written and/or graphic description of the use of overlays 210 with solution grids 202 for completing diagramless crossword puzzles. Preferably, instructions 220 include the method of using completion system 100, as shown and described above. In addition, instructions 220 may include various hints and tips for solving a diagramless crossword puzzle.

Kit 200 may further include a plurality of diagramless crossword puzzles compiled in a booklet or pamphlet 230 of clues and/or games. Preferably, the diagramless crossword puzzles contained in booklet 230 may vary in difficulty and size in order to provide the individual with countless hours of mind challenging entertainment and enjoyment.

Although the present disclosure has been described with respect to particular embodiments, it will be readily apparent to those having ordinary skill in the art to which it appertains that changes and modifications may be made thereto without departing from the spirit and scope of the present disclosure.

What is claimed is:

1. A crossword puzzle solution system for use in combination with a diagramless crossword puzzle, the puzzle having given overall dimensions in terms of a rectilinear array of cells contained therein, the puzzle being solvable on a solution grid of a given dimension which is greater than the overall dimension of the puzzle, the solution system comprising:

a plurality of overlays each having a first and a second surface, each overlay including a grid formed on the first surface thereof, the grid of each overlay defining an array of cells, wherein each overlay is selectively placeable on a surface of the solution grid such that the array of cells of the overlay correspond with the rectilinear array of cells of the solution grid, each overlay having an overall dimension which is less than the given dimension of the solution grid.

2. The system according to claim 1, wherein each overlay is fabricated from a flexible sheet material.

3. The system according to claim 2, wherein the flexible sheet material is at least one of a paper-based material and a plastic film-based material.

4. The system according to claim 3, wherein each overlay includes a coating of a selectively repositionable adhesive medium provided on at least a portion of the second surface thereof.

5. The system according to claim 4, wherein the adhesive medium is at least one of acrylate co-polymers, silicone materials, urethanes, and fluoro-polymers.

6. The system according to claim 5, wherein a plurality of overlays are operatively joined to one another in a sheet of overlays.

7. The system according to claim 6, wherein a plurality of sheets of overlays are operatively joined to one another in a stack.

8. The system according to claim 6, wherein each overlay of each sheet is separated from one another by a line of perforations.

9. The system according to claim 1, further comprising a set of instructions for using the solution system.

10. The system according to claim 9, further comprising at least one set of clues for completing a diagramless crossword puzzle.

11. A method of solving a diagramless crossword puzzle whose overall dimensions, in terms of a rectilinear array of cells contained therein, is given, the puzzle being solvable on a solution grid of a given dimension which is greater than the overall dimension of the puzzle, the method comprising the steps of:

providing a diagramless crossword puzzle solution system, the solution system including at least:

a plurality of overlays each having a first and a second surface, each overlay including a grid formed on the first surface thereof, the grid of each overlay defining an array of cells, wherein each overlay is selectively placeable and replaceable on a surface of a solution grid such that the array of cells of the overlay corresponds with a rectilinear array of cells of the solution grid, each overlay having an overall dimension which is less than the given dimension of the solution grid;

identifying corner cells of the diagramless crossword puzzle;

placing overlays on the solution grid;

beginning resolution of a portion of the diagramless crossword puzzle on the first overlay;

beginning resolution of other portions of the puzzle on at least one other overlay; and arranging and rearranging the overlays to resolve a diagram of the puzzle.

12. The method according to claim 11, further comprising the steps of:

calculating a length of a first Across answer;

numbering the cells to the right from an upper left-most cell from the number one up to the number of the length of the first Across answer; and marking a cell to the right of the cell corresponding to the final cell for the first Across answer, wherein no letter may be placed in said cell.

13. The method according to claim 12, further comprising the steps of:

placing another overlay over at least a portion of the first overlay;

transposing the marked cells of the first overlay to the another overlay.

14. The method according to claim 12, wherein the step of identifying the corner cells includes:

identifying Across clues and Down clues having common clue numbers; and marking the Across clues and the Down clues, sharing the common clue numbers, with an identifying indicia.

15. The method according to claim 14, wherein the step of calculating the length of the first Across answer includes:

subtracting the number one from a number of a second Across clue.

16. The method according to claim 15, wherein the step of beginning resolution of the puzzle includes at least one of determining answers for the Across clues and determining answers for the Down clues.

17. The method according to claim 16, further comprising the step of placing overlays on at least an upper-half portion of the solution grid.

18. The method according to claim 17, further comprising the step of placing answers to the clues onto the overlays placed on at least the upper-half portion of the solution grid.

19. The method according to claim 18, further comprising the step of:

placing additional overlays, as needed, on the overlays covering at least the upper-half portion of the solution grid; and transposing any marked cells from the overlays covering at least the upper-half portion of the solution grid to additional overlays.

20. The method according to claim 19, wherein the step of providing the completion system further includes:

providing at least one solution grid having a rectilinear array of cells, the solution grid configured to support a plurality of overlays thereon.

21. The method according to claim 20, wherein the step of providing the completion system further includes:

providing a set of instructions for using the completion system.

22. The method according to claim 21, wherein the overlays lay one atop at least a portion of another.

23. The method according to claim 11, wherein the placing of the first overlay on the solution grid includes the step of placing an upper left-most cell of the first overlay on a cell of the solution grid located in an upper row of the solution grid and on a cell of the solution grid located to the right of a left-most column of the solution grid.

24. A kit for completing a diagramless crossword puzzle whose overall dimensions, in terms of a rectilinear array of cells contained therein, is given, the kit comprising:

at least one solution grid having a given dimension which is greater than the overall dimension of the puzzle and defining a rectilinear array of cells thereon; and a plurality of overlays each having a first and a second surface and having a dimension less than the dimension of the solution grid, each overlay including a grid formed on the first surface thereof, the grid of each overlay defining an array of cells, wherein each overlay is selectively placeable and replaceable on a surface of the solution grid such that the array of cells of the overlay correspond with the rectilinear array of cells of the solution grid, wherein each overlay includes a coating of a selectively repositionable adhesive medium provided on at least a portion of the second surface thereof.

25. The kit according to claim 24, further comprising:

instructions for using the plurality of overlays to resolve a diagramless crossword puzzle.

26. The kit according to claim 25, further comprising a booklet of clues.

27. The system according to claim 1, wherein the solution grid is blank.

28. The Method according to claim 11, wherein the solution grid is blank.

29. The kit according to claim 24, wherein the solution grid is blank.

* * * * *